United States Patent [19]

Shapleigh

[11] 4,307,641

[45] Dec. 29, 1981

[54] PORTABLE SAWMILL

[76] Inventor: Robert Shapleigh, R.F.D. #3, Box 21, Dover Foxcroft, Me. 04426

[21] Appl. No.: 162,767

[22] Filed: Jun. 25, 1980

[51] Int. Cl.[3] ..... B27B 17/02

[52] U.S. Cl. ..... 83/574; 83/794; 83/795; 83/813

[58] Field of Search ..... 83/574, 743, 745, 813, 83/788, 794, 795

[56] References Cited

U.S. PATENT DOCUMENTS

| | | | |
|---|---|---|---|
| 3,374,812 | 3/1968 | McManama | 83/813 |
| 3,695,316 | 10/1972 | Pluckhahn | 83/743 |
| 3,721,146 | 3/1973 | McManama | 83/813 |
| 3,926,086 | 12/1975 | Crane | 83/745 |
| 3,954,037 | 5/1976 | Rios | 83/788 |
| 4,235,140 | 11/1980 | Reece | 83/794 |

*Primary Examiner*—Donald R. Schran

*Attorney, Agent, or Firm*—Shlesinger, Fitzsimmons & Shlesinger

[57] ABSTRACT

This mill comprises two parallel guide rails which are releasably attached to the upper ends of two spaced, vertically disposed end frames, the lower ends of which are releasably attached to two parallel, elongate skid members, which can be dragged along the surface of the ground to move the mill from one site to another. Two pointed log pins are carried by vertically adjustable blocks on the two end frames, with the pointed ends of the pins facing toward each other to be engageable in opposite ends of a log for supporting a log above the ground, and beneath the two guide rails. A chain saw carriage, which is slidable on the guide rails, supports a chain saw beneath the rails to have its cutting chain travel in a generally horizontal plane, and in position to cut elongate strips from a log when the carriage is moved manually from one end of the guide rails to the other. A device is also provided for adjusting the chain saw vertically on the carriage.

12 Claims, 5 Drawing Figures

PORTABLE SAWMILL

This invention relates to sawmills, and more particularly to a portable variety of sawmill which is operable by a single person. Even more particularly this invention relates to a novel sawmill which is designed to use a conventional chain saw for cutting purposes.

Conventional chain saws of the hand-held variety have become relatively inexpensive, and are therefore in reasonably plentiful supply among homeowners and builders. While they are frequently employed for cutting fire wood, for example, they are less often used for cutting timber, or the like, into finished boards because of the difficulty in manipulating the saws manually. Most finished boards, therefore, are usually prepared by conventional, industrial sawmills.

It is an object of this invention, therefore, to provide a novel sawmill capable of utilizing a conventional chain saw in such manner that an individual may readily employ the saw for producing finished timbers and boards directly from logs, or the like.

Another object is to provide a novel sawmill of the type described which is readily adjustable to accommodate logs of various sizes, and which is readily portable to a site where lumber is to be cut.

Still another object of this invention is to provide a sawmill of the type in which the cutting power is supplied by a conventional chain saw that is supported removably and adjustably on a portable frame in such manner that the saw can be readily adjusted on the frame to cut finished boards of different configurations from a log, or the like.

Another object of this invention is to provide a novel portable one-man sawmill in which both the work and the cutting saw can be adjusted relative to each other selectively to cut the work (log, e.g.) into boards, timbers, clapboards, shingles, etc.

Other objects of the invention will be apparent hereinafter from the specification and from the recital of the appended claims, particularly when in conjunction with the accompanying drawings.

Figure 5:
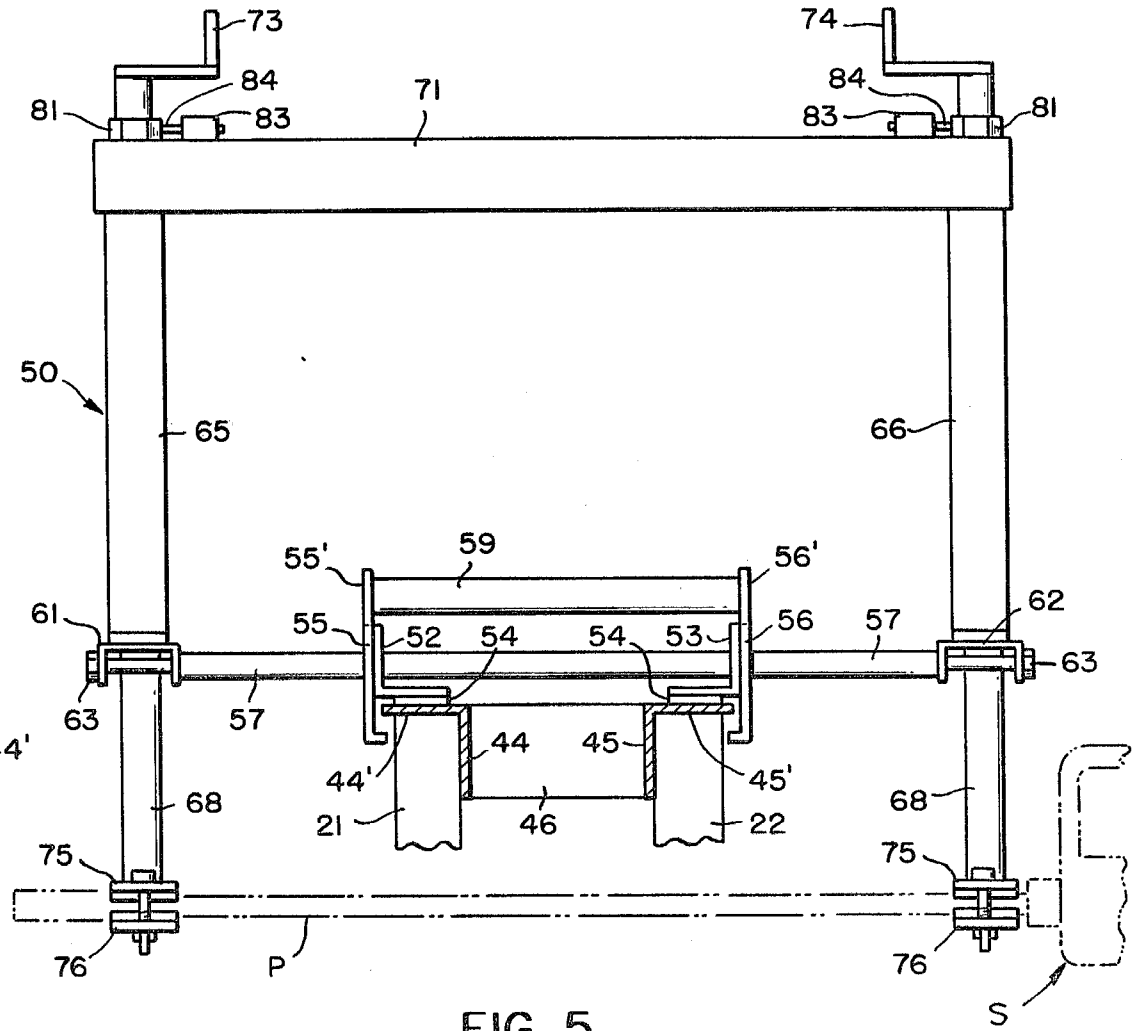
Figure 4:
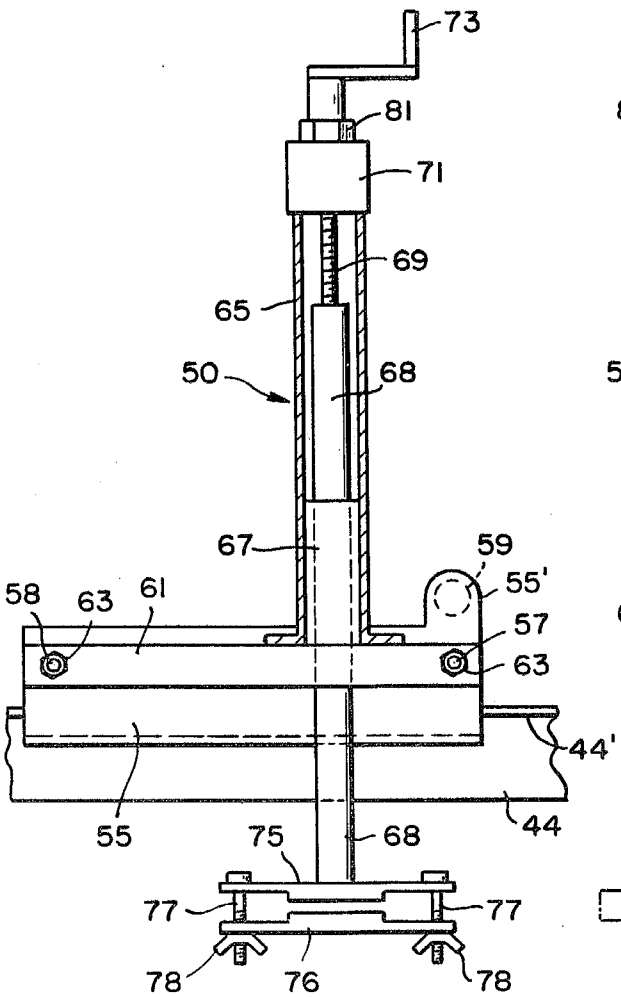

FIG. 4 is an enlarged, side elevational view of the adjustable saw carriage which forms part of this mill, part of the carriage being cut away and shown in secton, and the frame guide rails upon which the carriage is mounted being shown fragmentarily; and FIG. 5 is an end elevational view of this saw carriage with a chain saw mounted therein as shown in phantom by broken lines, and with portions of the mill frame being shown fragmentarily.

Figure 1:
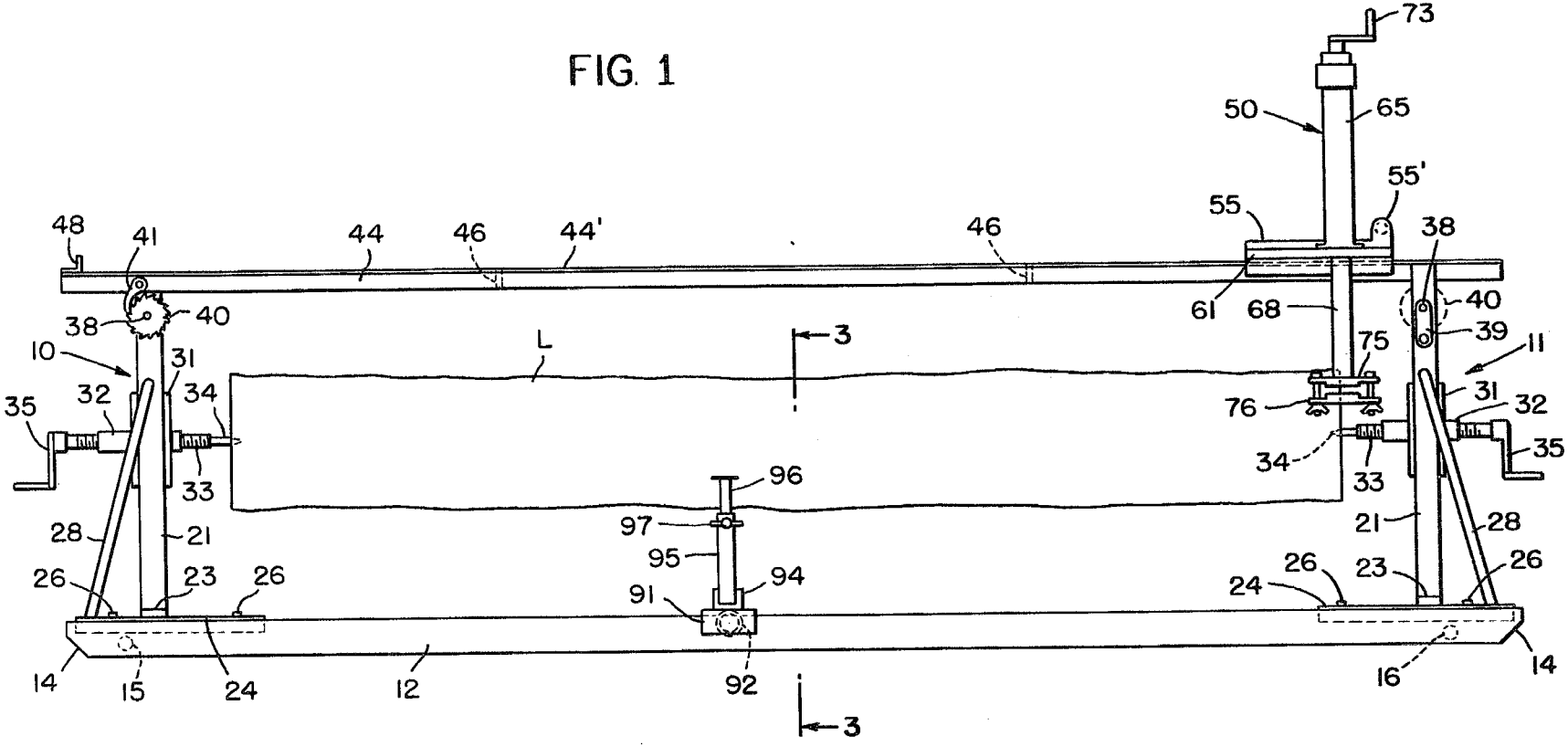
FIG. 1 is a side elevational view of a portable sawmill made according to one embodiment of this invention, and with a log being shown held in an operating position in the mill.
Figure 2:
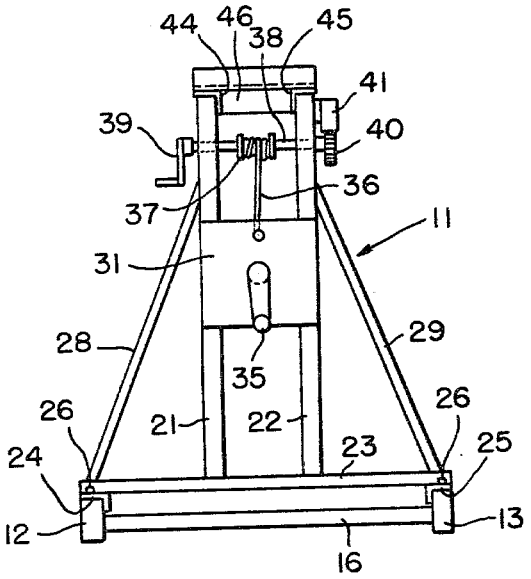
FIG. 2 is an end elevational view of the mill, but with its adjustable saw carriage removed therefrom.

Referring now to the drawings by numerals of reference, and first to FIGS. 1 and 2, numerals 10 and 11 denote, generally, two vertically disposed end frames which are adjustably mounted on opposite ends of a pair of elongate skids or rails 12 and 13, opposite ends of which are inclined upwardly as at 14 (FIG. 1) so that the rails can be skidded on the ground in either direction. These rails, which in practice may comprise steel channel rails, are secured in spaced, parallel relation by a pair of transversely extending members 15 and 16, which may be sections of steel pipe opposite ends of which are welded or otherwise secured to the confronting sides of rails 12 and 13 adjacent their ends.

Each of the upstanding end frames 10 and 11, which are substantially identical in configuration, comprises a pair of spaced, parallel vertically disposed metal posts or beams 21 and 22, the lower ends of which are welded or otherwise secured to the upper surface of a horizontal supporting bar 23, which extends transversely between the rails 12 and 13. Each bar 23 at opposite ends thereof is fixed to the upper surfaces of a pair of angle irons 24 and 25, which are mounted on the skids 12 and 13 for adjustment into different operating positions thereon. For example, each of the angle irons 24 and 25 may be secured by a plurality of screws or bolts 26 to the upper surface of the associated rail 12 and 13 respectively. The rails 12 and 13 have in their upper surfaces a plurality of longitudinally spaced openings in which the bolts 26 can be positioned to secure the associated angle irons 24 and 25, and hence the frames 10 and 11, in different longitudinal positions on the tail 12 and 13. Each pair of posts 21 and 22 is supported against movement on its respective supporting bar 23 and angle irons 24 and 25 by means of a pair of rigid struts or rods 28 and 29, which are fastened at their upper ends to the posts 21 and 22, respectively, and at their lower ends to the associated angle iron 24 and 25, respectively.

Slidably mounted between the two posts 21 and 22 of each end frame 10 and 11 for vertical adjustment thereon is a rectangular elevating block 31. Secured intermediate its ends in the center of each block 31, and projecting from opposite sides of the block is an internally threaded sleeve 32, the bore of which extends parallel to the rails 12 and 13. Threaded into the bore of each sleeve 32 is an externally-threaded log screw pin 33, which has a pointed end 34 that is disposed to engage and to support one end of a log L, or the like, when the mill is in use. Secured to the outer end of each pin 33 remote from its pointed end 34 is a handle 35 by means of which the associated pin can be threadably adjusted in its supporting sleeve 32. As shown more clearly in FIG. 1, the two pins 34, face toward each other so as to be engagable in opposite ends of the log L or other timber which is to be cut.

Each block 31 is connected to one end of a cord 36 (FIG. 2), the opposite end of which is secured to a winch drum 37. Each drum 37 is fixed to a rotatable shaft 38, opposite ends of which are journaled in the associated frame posts 21 and 22 adjacent the upper ends thereof. Each shaft 38 has fixed on one end thereof a handle 39, and on its opposite end a ratchet wheel 40, the teeth of which are positioned for engagement by the tooth of a conventional pawl 41, which is mounted on the upper end of one of the posts 21 and 22 for pivotal movement about an axis parallel to the associated shaft 38. Obviously each handle 39 can be manipulated to effect the corresponding raising or lowering of the associated elevating block 31, which in turn either raises or lowers the associated log-supporting pin 33 relative to ground level.

Two elongated guard rails 44 and 45, which in the embodiment illustrated are shown to be angle irons, are releasibly secured adjacent opposite ends to the upper ends of the posts 21 and 22 of each frame so that the sides or legs 44′ and 45′ (FIG. 5) of the rails 44 and 45, respectively, are disposed in a common horizontal plane. Intermediate their ends the guard rails 44 and 45 are secured in spaced, parallel relation by a pair of rectangular spacer plates 46, which extend between the confronting sides of the rails 44 and 45. A carriage stop 48 (FIG. 1) in the form of a small section of angle iron is secured to and extends transversely across the upper surfaces of the guard rails 44 and 45 at one end thereof for a purpose noted hereinafter.

Mounted for longitudinal sliding adjustment on the guard rails 44 and 45 is a chain saw carriage, which is denoted generally by the numeral 50. This carriage comprises a pair of spaced, parallel angle irons 52 and 53, each of which has a horizontally disposed leg secured to a plastic anti-friction pad 54 which slides on the upper surface of one of the rails 44 and 45. Each angle iron 52 and 53 also has a vertically disposed side or leg which is fastened to the inside surface of one of two, spaced side plates 55 and 56. Plates 55 and 56 are secured in spaced, parallel relation by two elongate, parallel rods 57 and 58, which extend through and are secured intermediate their ends in registering openings in the side plates 55 and 56 and the vertically disposed legs of angle irons 52 and 53. As shown more clearly in FIGS. 4 and 5, the angle irons 52 and 53, the side plates 55 and 56, and the rods 57 and 58 are thus supported by the anti-friction pads 54 for sliding movement as a unit on the upper surfaces of the longitudinally extending guide rails 44 and 45. Also as shown in these figures, the side plates 55 and 56 extend downwardly beyond the longitudinal side edges of the guide rails 44 and 45 to limit or prevent any undesirable lateral movement of the carriage 50 on the guide rails.

Longitudinal movement of this slide or saddle section 52–58 of the carriage can be readily effected by means of a cylindrical handle 59, which is secured to, and which extends transversely between a pair of upstanding lugs 55' and 56', which are formed on end each of the plates 55 and 56, respectively.

As shown more clearly in FIG. 5, the two supporting rods 57 and 58 project at opposite ends beyond the side plates 55 and 56, and have thereon reduced-diameter sections which extend through the sides of a pair of inverted channel irons 61 and 62, and which are secured thereto by means of nuts 63 which thread onto the terminal ends of the rods. The members 61 and 62 are thus secured or supported by the rods 57 and 58 in spaced, parallel relation to each other, and to the guide rails 44 and 45.

Secured at their lower ends to the upper surfaces of the horizontally disposed members 61 and 62, and projecting vertically upwardly therefrom, are two, parallel, tubular casings 65 and 66. Mounted for vertical sliding movement in each of a pair sleeves 67, which are fastened in casings 65 and 66, respectively, is an elongate, cylindrical, saw-supporting rod 68. Adjustably threaded into an axial bore, which is formed in the upper end of rod 68, is an adjusting screw 69. Each screw 69 is rotatably journaled at its upper end in a conventional manner in opposite ends of a cap member 71, which extend transversely between, and is fastened to, the upper ends of the two casings 65 and 66. The rotatable adjusting screws 69 project through cap members 71 and have fastened to their upper ends a pair of manually-operable cranks or handles 73 and 74, respectively. These cranks can be rotated in opposite directions either to raise or to lower the respective supporting rods 68, as noted hereinafter.

The adjustable supporting rods 68 (FIGS. 4 and 5) project out of the lower ends of casings 65 and 66 and through registering openings in the associated supporting members 61 and 62. One of two cooperating clamping elements 75, which may be of conventional configuration, is fastened to the lower end of each supporting rod 68; and a cooperating element 76 is adjustably mounted in confronting relation to each stationary element 75 by means of a pair of conventional bolts 77 and wing nuts 78 (FIG. 4).

In use, the two frame hubs, which support the rotatable sprocket wheels of a conventional chain saw S (broken lines in FIG. 5), are adapted to be releasably secured in an obvious manner by the clamps 75, 76, to the lower ends of the two supporting rods 68 in such way that cutting teeth on the chain portion of the saw will travel, for example, in a horizontal plane P (FIG. 5) some distance beneath the guard rails 44 and 45, depending upon the extent to which the supporting rods 68 project beneath the horizontal support members 61 and 62. As noted above, the handles 73 and 74 can be rotated to raise or to lower the supporting members 66, and consequently the saw attached thereto.

Secured to each handle 73 and 74 to be rotated thereby adjacent the upper surface of the cap member 71 is a nut 81, the outer surface of which may be case hardened. Secured on the cap number 71 adjacent each nut 81 is a housing 83 containing a spring-loaded stop plunger 84. The outer end of each plunger 84 resiliently engages the outer surface of the adjacent nut 81, thereby tending resiliently to retain each nut 81 and its associated handle 73 or 74 in an adjusted position. Plungers 84 thus provide means for releasably securing the chain saw S in any one of a number of different vertical positions relative to the guide rails 44 and 45.

Figure 3:
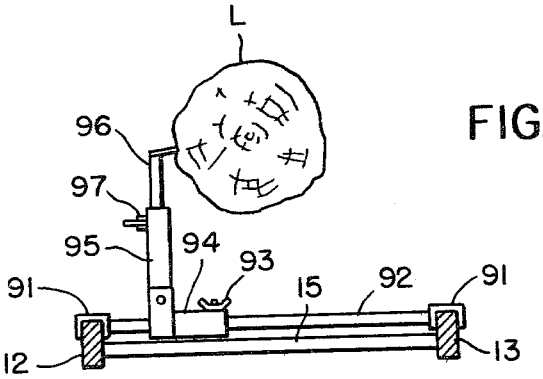
FIG. 3 is a fragmentary sectional view taken generally along the line 3—3 in FIG. 1 looking in the direction of the arrows.

Secured at opposite ends to a pair of channel irons 91 (FIGS. 1 and 3), which are mounted for sliding adjustment on the upper surfaces of the skid rails 12 and 13, is a transversely extending pipe member 92. Secured by wing nut 93 for longitudinal adjustment on member 92 is a tubular casing 94. Slidably mounted at its lower end in the bore of a tubular housing 95, which projects upwardly from one end casing 94, is an adjustable log dog 96, which has a pointed end that is disposed to be engaged with the side of log L during operation of the mill. The dog 96 is adapted to be secured in an adjusted position in the housing 95 by means of, for example, a wing nut 97 or the like.

In use, the mill may be skidded on its rails 12 and 13 to the site where logs or wooden beams are to be cut. Assuming that logs L of the type shown in FIG. 1 are to be cut, a log is rolled or otherwise positioned between the end frames 10 and 11, and the handles 39 are manipulated to lower the blocks 31 until the log screw pins 33 are positioned approximately in registry with opposite ends of the log. At this time, or before if desired, one or the other of the end frames 10 or 11 can be adjusted longitudinally of the rails 12 and 13, if necessary, placing it either closer to or further away from the other end frame, depending upon the length of the log to be cut. This also positions pins 33 so they are approximately adjacent opposite ends of the log. When this has been done the handles 35 are manipulated to drive the points 34 into opposite ends of the log, after which the handles 39 can again be manipulated to raise the blocks 31, and consequently the log L, into the desired elevated position.

At this time the carriage 50 is positioned adjacent one end of the guide rails 44 and 45, so that the saw carried thereby will have its cutting teeth arranged to travel in a plane located beneath the upper peripheral surface of the now-horizontally disposed log. Then, with the saw operating, the carriage 50 can be pushed by handle 59, for example, from the right toward the left in FIG. 1, thereby cutting longitudinally through the log from one end thereof to the other. During this motion the weight of the saw is supported by the carriage on the guard rails 44 and 45. Also at this time the dog 96 may have its operating end engaged with the outer peripheral surface of the log L to prevent any undesirable rotational movement of the log during the cutting operation.

As will be apparent to one skilled in the art, the elevating blocks 31 can be adjusted vertically either to raise or to lower one end of the log relative to the other, thereby enabling pieces of wood of different cross sectional configurations to be cut from the log. For example, assuming that a first cut is made longitudinally of the log while the latter is generally parallel to the ground, and that before making the next cut one end only of the log (for example the right end as shown in FIG. 1) is elevated slightly, then when the second cut is made by moving the carriage 50 from the right toward the left end of the mill, the second section cut from the log will have one surface thereof inclined to the other. In this way it is possible to produce different cuts of wood, for example, clapboards, shingles, and the like. Likewise, it is possible also to tilt the travel of the saw teeth slightly out of a horizontal plane, if desired, merely by raising or lowering one end of the saw relative to the other by effecting corresponding adjustments of the supporting rods 68 through the agency of their operating handles 73 and 74, respectively.

From the foregoing it will be apparent that the present invention provides a relative simple but extremely versatile and portable sawmill, which can be readily operated by a single person. It is particularly suitable for use by do-it-yourselfers, who can use the mill to saw boards, timbers, clapboards, shingles, docorative posts, etc. The mill thus enables a single person to do what, under other circumstances, might require the assistance of several people, as well as substantially more sophisticated equipment in order to produce cut boards of the type described. Its design enables the mill to be manufactured from extremely sturdy, reasonably inexpensive materials. Moreover, during use it can readily be adjusted to minimize the amount of labor involved in, for example, elevating logs or beams into cutting positions. Moreover it not only enables boards of almost any shape or configuration to be cut, but it also permits various types and sizes of chain saws to be supported on the carriage 50, depending on the size and shapes of clamps 75, 76.

While this invention has been illustrated and described in detail in connection with only one embodiment thereof, it will be apparent that it is capable of still further modification, and that this application is intended to cover any such modifications as may fall within the scope of one skilled in the art, or the appended claims.

What I claim is:

1. A portable saw mill, comprising a frame mounted on skids to enable the frame to be moved by dragging on the ground, a pair of spaced, parallel guide rails mounted on said frame to be supported generally horizontally thereby above the surface of the ground upon which the frame is mounted, a pair of spaced log-supporting members mounted on said frame beneath said pair of rails and releasably engageable with opposite ends of a log to support the latter on said frame beneath said rails, at least one of said members being adjustable longitudinally on said frame relative to the other, means for releasably supporting a chain saw on said frame for sliding adjustment longitudinally of said rails and with the cutting chain of said saw positioned to travel beneath said rails and in a generally horizontal plane, means mounting said log-supporting members for vertical adjustment on said frame and operable, when a log is supported between said members, to shift one end of the log, selectively, higher than, lower than, or in horizontal registry with, the other end thereof.

2. A portable saw mill as defined in claim 1, wherein said mounting means comprises a pair of spaced, vertically disposed end frames secured at their lower ends to the first-named frame adjacent opposite ends thereof, and attached at their upper ends to said guide rails adjacent opposite ends, respectively, of the pair thereof, thereby to support said rails on said first-named frame, and a block mounted on each of said end frames for vertical adjustment thereon independently of each other, each of said blocks carrying one of said log-supporting members.

3. A portable saw mill as defined in claim 2, wherein each of said log-supporting members comprises a pin adjustably mounted intermediate its ends to rotate in one of said blocks about an axis extending transverse to the associated block, and parallel to said guide rails, said pins having pointed ends facing each other for engagement in opposite ends of the log supported on the first-named frame, and each of said pins being mounted for limited axial adjustment relative to its associated block, upon rotation of the pin relative to its block, thereby to permit limited adjustment of said pins toward and away from each other, respectively.

4. A portable saw mill as defined in claim 3, including means releasably attaching at least one of said end frames to said first-named frame and to said guide rails, and operative to permit said one end frame to be secured adjustably in one of several different positions on said first-named frame, thereby to permit adjustment of the distance between said end frames and log-supporting members.

5. A portable saw mill as defined in claim 1, wherein said chain saw supporting means comprises a slide mounted on said rails for longitudinal sliding adjustment thereon, a pair of spaced, parallel, vertically disposed rods carried by said slide and extending downwardly beyond said rails adjacent opposite sides, respectively, of the pair thereof, and means for releasably mounting a chain saw on the lower ends of said rods to extend therebetween beneath said guide rails.

6. A portable saw mill as defined in claim 5, including means mounting each of said rods on said slide for vertical adjustment thereon relative to said slide and to said guide rails.

7. A portable saw mill as defined in claim 6, wherein said mounting means for said rods comprises a pair of spaced, parallel, vertically disposed sleeves carried by said slide and supporting said rods for axial, sliding adjustment in the bores thereof, a rotatable handle mounted on each of said sleeves and connected to the rod therein to effect axial adjustment of said rod relative to the associated sleeve, when the handle is rotated, and means for releasably securing said handles against rotation thereby releasably to retain said rods in adjusted positions in said sleeves.

8. A portable saw mill as defined in claim 1, including a log dog mounted at its lower end of said frame beneath said guide rails for adjustment transversely thereof, said dog having on its upper end a pointed projection disposed to engage the periphery of log supported on said frame by said log-supporting members.

9. A portable saw mill comprising a frame having thereon an elongate, generally horizontally disposed carriage guide disposed to be supported off the ground by said frame, a chain saw carriage mounted on said guide for manual sliding movement longitudinally thereof, means on said carriage for releasably supporting a chain saw for vertical adjustment beneath said guide and with its cutting chain disposed to travel in a substantially horizontal plane, means for supporting a length of wood on said frame beneath and generally parallel to said guide, and in the path of travel of said cutting chain during movement of said carriage longitudinally on said guide, said means for supporting a length of wood comprising means for selectively raising or lowering one end of said length of wood relative to the other while supported on said frame, thereby selectively to incline the axis of said length of wood to the horizontal, slide means on said carriage having sliding engagement with a plane, upper surface on said guide, and projecting downwardly at opposite sides of said guide to minimize any lateral sliding movement of the carriage during movement thereof longitudinally of said guide, and a handle on said slide means extending transversely of said guide and adapted to be gripped and manipulated manually to reciprocate said carriage on said guide.

10. A portable saw mill as defined in claim 9, including a transverse stop member secured on said guide adjacent one end thereof and engageable by said slide means to prevent the latter from sliding off of said one end of the guide.

11. A portable saw mill as defined in claim 9, wherein said carriage further comprises a pair of spaced, parallel, vertically disposed sleeves supported on said slide means adjacent opposite sides, respectively, thereof, a pair of rods slidable in said sleeves coaxially thereof and projecting at their lower ends downwardly beyond opposite sides, respectively, of said guide, and clamp means on the lower end of each of said rods releasably attachable to part of a chain saw to support the latter on said carriage.

12. A portable saw mill as defined in claim 11, including means on said carriage connected to said rods and manually adjustable selectively to move said rods axially back and forth in the bores in said sleeves, thereby to adjust the vertical positions of said clamp means relative to said guide.

* * * * *